US006029756A

United States Patent [19]

Britzke et al.

[11] Patent Number: 6,029,756

[45] Date of Patent: Feb. 29, 2000

[54] NOZZLE POSITIONING ASSEMBLY

[75] Inventors: Robert W. Britzke, Rogers, Ark.; Harry E. Nover, Woodlands, Tex.

[73] Assignee: Rogers Tool Works, Inc., Rogers, Ark.

[21] Appl. No.: 08/958,087

[22] Filed: Oct. 27, 1997

[51] Int. Cl.[7] ..... E21B 10/60

[52] U.S. Cl. ..... 175/57; 175/340; 175/393; 175/424; 239/598

[58] Field of Search ..... 175/340, 339, 175/393, 424, 57; 239/598, 600

[56] References Cited

U.S. PATENT DOCUMENTS

| | | | |
|---|---|---|---|
| Re. 31,495 | 1/1984 | Zublin . | |
| 1,954,863 | 4/1934 | Coles et al. | 299/121 |
| 3,447,755 | 6/1969 | Cartwright | 239/551 |
| 3,900,220 | 8/1975 | Buchser . | |
| 4,050,633 | 9/1977 | Courson | 239/550 |
| 4,126,338 | 11/1978 | Coel et al. . | |
| 4,365,758 | 12/1982 | Schaming | 239/590 |
| 4,427,221 | 1/1984 | Shay, Jr. | 285/305 |
| 4,533,005 | 8/1985 | Morris . | |
| 4,582,149 | 4/1986 | Slaughter, Jr. | 175/340 |
| 4,600,222 | 7/1986 | Appling . | |
| 4,658,918 | 4/1987 | Matson | 175/423 |
| 4,718,607 | 1/1988 | Levine . | |
| 4,776,412 | 10/1988 | Thompson . | |
| 4,794,995 | 1/1989 | Matson et al. . | |
| 4,901,687 | 2/1990 | Jones . | |
| 5,271,566 | 12/1993 | Dederich . | |
| 5,321,205 | 6/1994 | Bawa et al. . | |
| 5,337,958 | 8/1994 | Hennessy et al. . | |
| 5,350,201 | 9/1994 | Bynum . | |
| 5,494,122 | 2/1996 | Larsen et al. | 175/340 |
| 5,575,409 | 11/1996 | Gruendeman . | |

*Primary Examiner*—Hoang Dang
*Attorney, Agent, or Firm*—Dickstein Shapiro Morin & Oshinsky LLP

[57] ABSTRACT

A nozzle assembly for use in a drill bit includes a nozzle body having a nozzle oriented at an angle to the longitudinal axis of the nozzle body and a positioning ring that is rotationally and axially locked to the nozzle body. The nozzle body includes a plurality of facets extending between a pair of retention surfaces. The positioning ring has a plurality of teeth and is operatively disposed between the retention surfaces to axially retain the ring on the nozzle body. When positioned between the retention surfaces, the teeth engage the facets to rotationally lock the ring to the nozzle body. The positioning ring may have a longitudinal split, to allow the ring to ratchet relative to the nozzle body, and a pair of spanner-receiving apertures. In operation, the ring is coupled to the nozzle body and the resultant assembly is coupled to the drill bit. Any misalignment is noted and the assembly is removed from the drill bit. A spanner wrench may be used to rotate the ring relative to the nozzle body to compensate for the misalignment. The assembly is then recoupled to the drill bit with the nozzle in the preferred orientation.

19 Claims, 4 Drawing Sheets

NOZZLE POSITIONING ASSEMBLY

BACKGROUND OF THE INVENTION

The present invention relates to nozzles for use in drill bits and particularly to nozzles having an internal passage that is offset at an angle from the longitudinal axis of the nozzle. More particularly, the invention relates to a method and apparatus for properly aligning the outlet of the internal passage relative to the drill bit.

In rotary drilling operations, a rotating drill bit cuts soil and rock as it is advanced through the rock formation. The cuttings are flushed away from the drill bit and up the borehole by high pressure drilling fluid supplied through a passage in the drill stem. The drilling fluid is directed outwardly from the drill bit through nozzles in the face of the drill bit.

Typically, the nozzles are retained in the drill bit by male threads on the nozzle. The threads are screwed into matching female threads in the body of the drill bit until the nozzle bottoms out. As long as the nozzle is cylindrical in shape and no specific angular orientation is needed, a conventional nozzle is functional.

Some nozzles used in drill bits are non-symmetric and require precise orientation in the drill bit. However, because of uncertainties in thread position, or clocking, in both the bit and the nozzle, it is impossible to predict in advance what the angular position of the nozzle will be when it is threaded into the drill bit until it is fully seated. Thus, some type of field adjustment is necessary.

A conventional approach to providing field adjustment, such as disclosed in U.S. Pat. No. 4,533,005 to Morris and U.S. Pat. No. 4,776,412 to Thompson, is to provide a threaded ring around a nozzle body that attaches the nozzle to the drill bit. The nozzle body is rotatable relative to the threaded ring after the ring is seated in the drill bit which allows the nozzle to be properly oriented within the drill bit. Unfortunately, the conventional approach requires the use of special tools in the field, which is inconvenient and expensive. An additional disadvantage is that, if the threaded ring begins to back out of the drill bit, the nozzle body is free to rotate within the ring relative to the drill bit and thereby lose the proper orientation.

SUMMARY OF THE INVENTION

The present invention overcomes to a great extent the disadvantages of the prior art by providing a nozzle body having a nozzle oriented at an angle to the longitudinal axis and a positioning ring, with the nozzle body and positioning ring cooperating to allow the nozzle to be properly oriented within a drill bit without the use of special tools. Moreover, the nozzle body of the present invention is rotationally locked to the positioning ring so that it will not freely rotate if the positioning ring should start to back out of the drill bit.

In one aspect of the invention, the nozzle body has an exterior surface with a pair of retention surfaces. A plurality of facets extend between the retention surfaces and cooperate with each other to form a polygon.

The positioning ring may have a toothed interior surface and a threaded exterior surface. The teeth on the interior surface engage the facets of the nozzle body to rotationally lock the positioning ring to the nozzle body and engage the retention surfaces to axially lock the positioning ring to the nozzle body, while the threads on the exterior surface engage threads in the drill bit to retain the nozzle body within the drill bit.

The positioning ring further includes a longitudinally extending gap that allows the positioning ring to be installed on the nozzle body and subsequently rotated relative to the nozzle body to allow for correction of misalignment between the nozzle outlet direction and the preferred orientation.

In another embodiment of the invention, the nozzle body includes a raised portion defined by a plurality of teeth extending radially outwardly from the external surface. The positioning ring includes a plurality of sidewall segments that cooperate to form a sidewall. The interior surface of the sidewall includes teeth configured for engaging the nozzle body teeth.

The present invention also relates to a method of reorienting the nozzle body relative to the drill bit. According to a preferred method, the positioning ring is installed on the nozzle body and the assembly is screwed into the drill bit. The misalignment of the nozzle is determined and the assembly is removed from the drill bit. The positioning ring is ratcheted, or rotated, relative to the nozzle body to correct for the misalignment, and the assembly is then screwed into the drill bit with the nozzle properly oriented.

It is an object of the invention to provide a nozzle assembly with a positioning ring that allows adjustment of the orientation of a nozzle relative to a drill bit.

It is another object of the invention to provide a positioning ring that allows adjustment of the orientation of a nozzle in a drill bit without the use of special tools.

It is yet another object of the invention to provide a positioning ring that is rotationally and axially locked to the nozzle body.

These and other objects, features and advantages of the invention will become apparent from the following detailed description of preferred embodiments of the present invention.

DETAILED DESCRIPTION OF PREFERRED EMBODIMENTS

Figure 1:
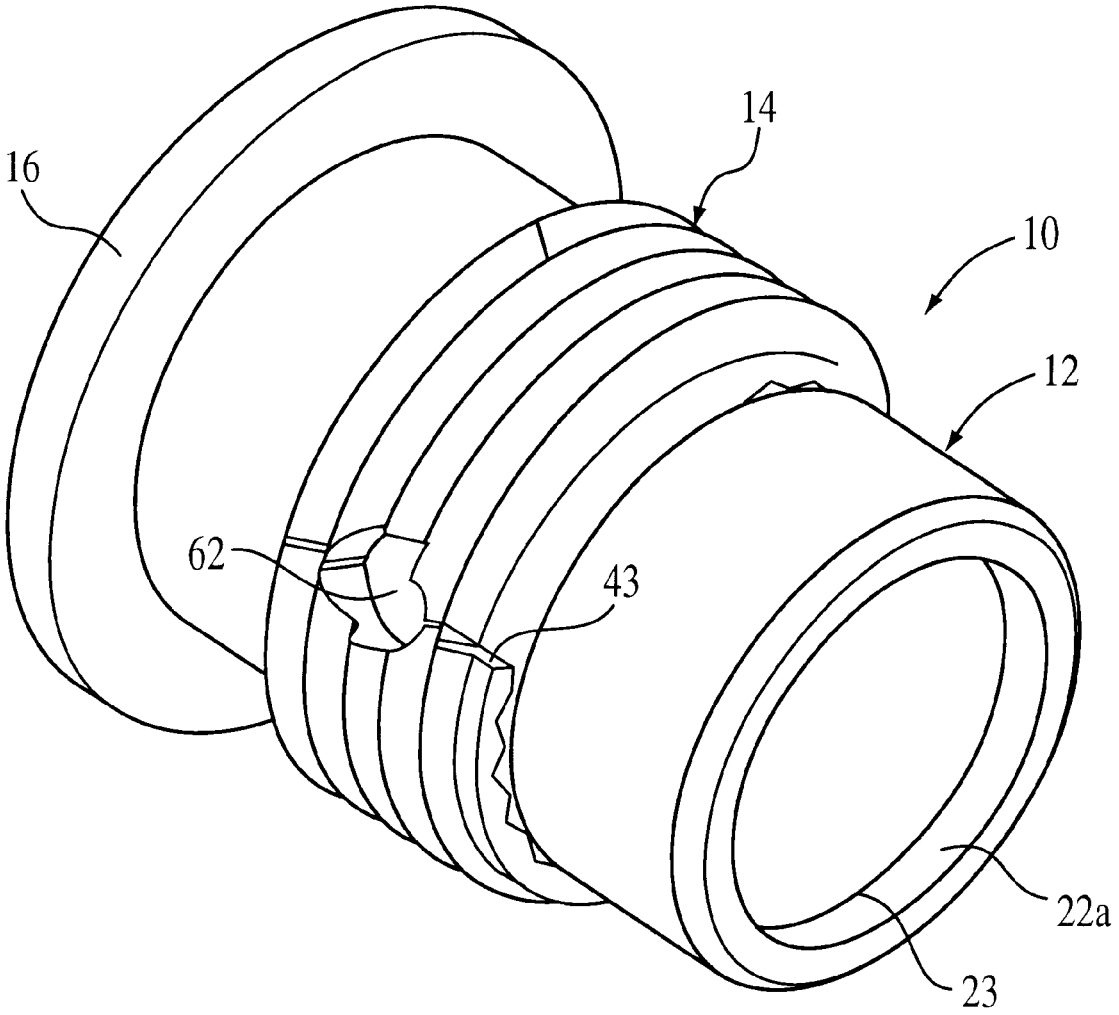
FIG. 1 is a perspective view of a nozzle assembly constructed in accordance with a preferred embodiment of the invention.
Figure 8:
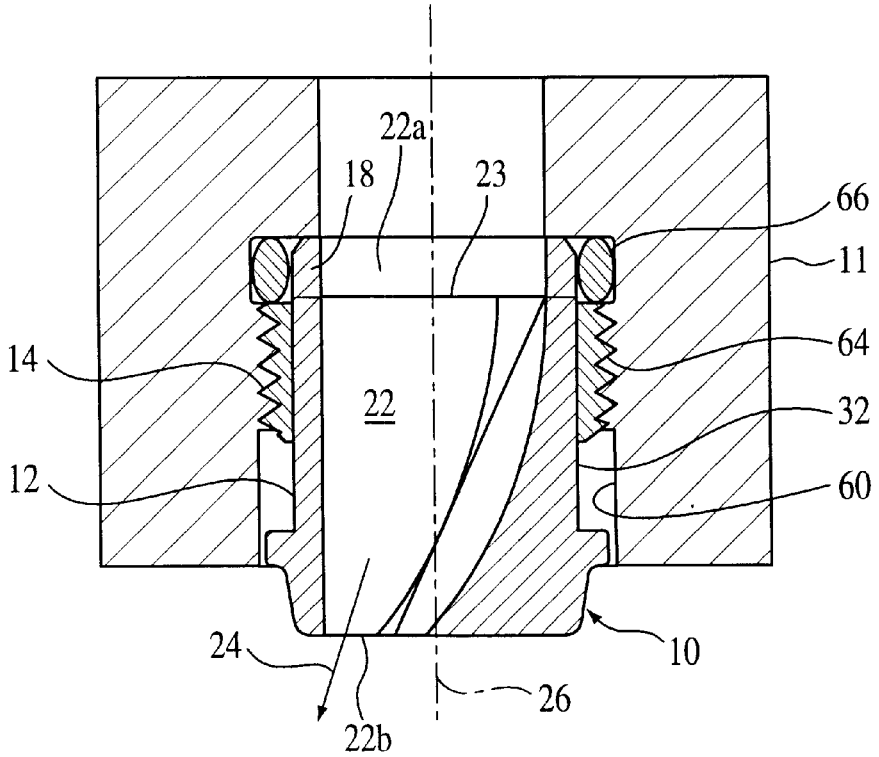
FIG. 8 is a section view through a drill bit with a nozzle assembly operatively positioned in a receiving aperture.
Figure 9:
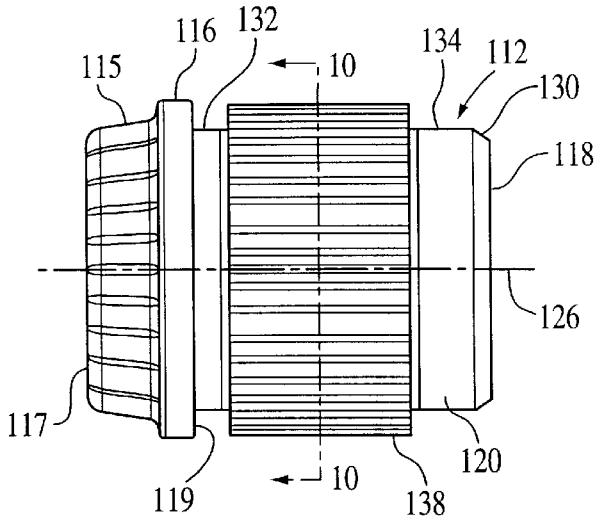
FIG. 9 is a side view of another nozzle body constructed in accordance with the present invention.
Figure 10:
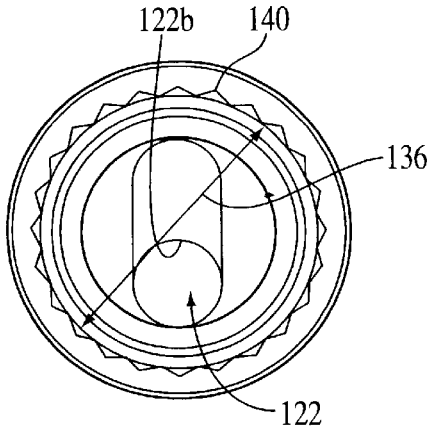
FIG. 10 is a transverse section view through the nozzle body taken along line 10—10 of FIG. 9.

A nozzle assembly 10 is illustrated in FIG. 1. The nozzle assembly 10 includes a nozzle body 12 and a resilient positioning ring 14. The nozzle assembly 10 is adapted for use in a drill bit 11 (FIG. 8).

Figure 3:
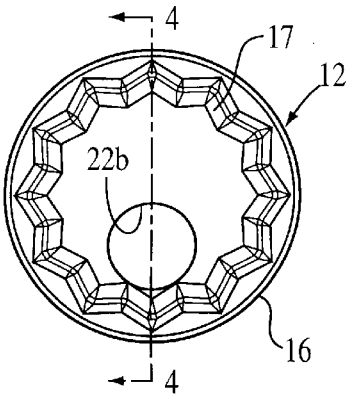
FIG. 3 is an end view of the nozzle body of FIG. 2 showing a nozzle outlet.
Figure 2:
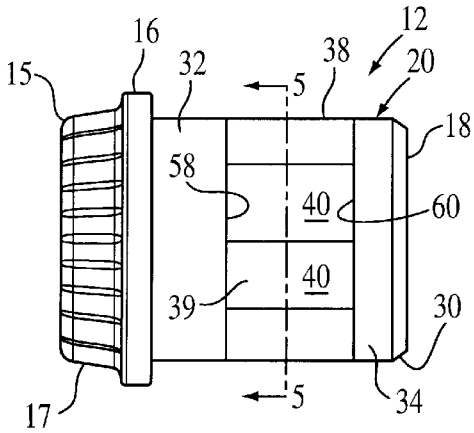
FIG. 2 is a side view of a nozzle body for use with the nozzle assembly of FIG. 1.
Figure 4:
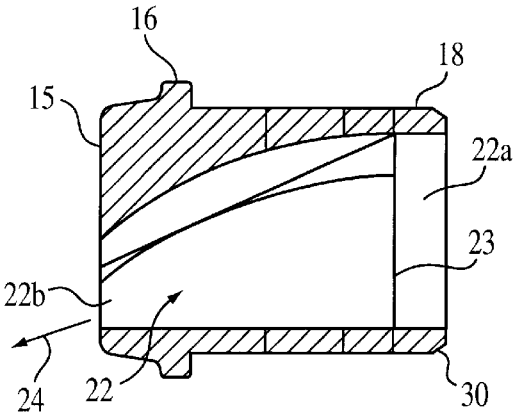
FIG. 4 is a cross section view of the nozzle body of FIG. 2, taken along the line 4—4 of FIG. 3, showing a nozzle oriented at an angle to the longitudinal axis of the nozzle body.

The nozzle body 12, illustrated in FIGS. 2–4, includes a proximal end 15, a flange 16 extending radially outwardly from the proximal end 15, a distal end 18, an exterior surface 20 and an internal passage 22 defining a nozzle. In preferred embodiments, a twelve point driven member 17 extends axially from the proximal end 15 and is configured to receive a conventional driver (not shown) such as a socket wrench.

The nozzle 22 is non-symmetric and includes an inlet 22*a* formed in the distal end 18 and an outlet 22*b* formed in the proximal end 15. The nozzle inlet 22*a* has an initially cylindrical cross-section that begins to converge at 23 toward the outlet 22*b*. The nozzle outlet 22*b* is oriented along outlet direction 24 at an acute angle to the longitudinal axis 26 of the nozzle body 12.

The distal end 18 includes a beveled seating surface 30 for seating the nozzle body 12 in the drill bit 11 (FIG. 8) and accommodating an O-ring 66 during insertion into the drill bit 11.

Figure 5:
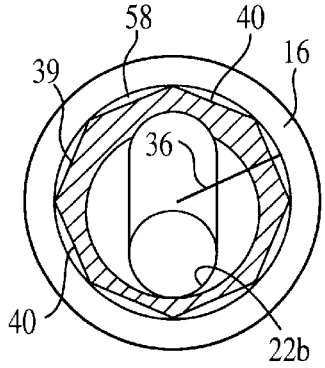
FIG. 5 is a transverse section view of the nozzle body of FIG. 2 taken along line 5—5.

The exterior surface 20 preferably includes first and second generally cylindrical portions 32, 34 having an outer diameter 36 (FIG. 5). A recessed portion 38 is formed in the exterior surface 20 between the first and second cylindrical portions 32, 34 and is defined by a plurality of facets 40 forming a polygon 39 and first and second retention surfaces 58, 60. In preferred embodiments, the polygon 39 is an octagon, but other polygons can be used. It will be further understood that the facets 40 need not be flat surfaces, as illustrated. However, it is preferred that the polygon 39 be symmetric about its center with all of the facets 40 being generally the same so that there is no preferred orientation of the positioning ring 14 with respect to the nozzle body 12.

Figure 6:
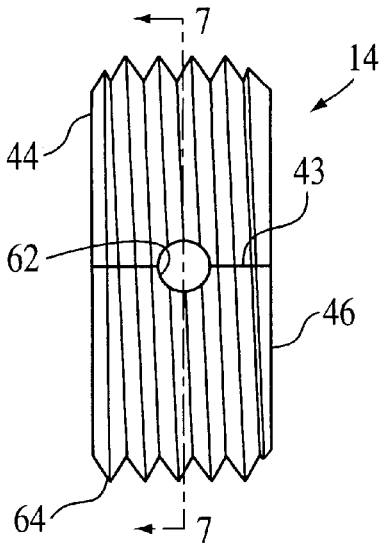
FIG. 6 is a side view of a positioning ring for use with the nozzle body of FIG. 2.
Figure 7:
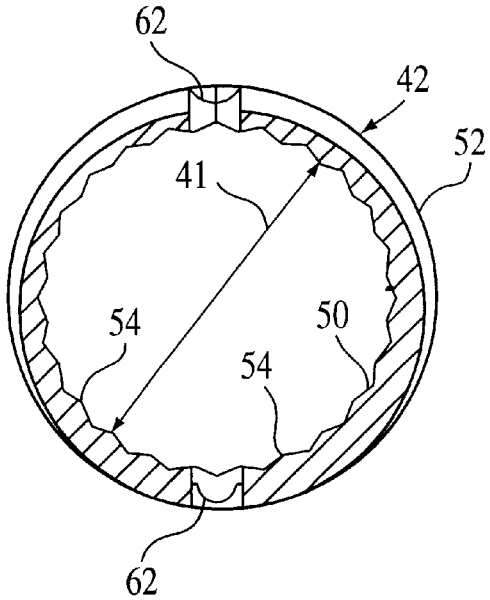
FIG. 7 is a transverse section view of the positioning ring taken along line 7—7 of FIG. 6.

The positioning ring 14, illustrated in FIGS. 6–8, includes an annular sidewall 42 (FIG. 7) having an inner diameter 41, a pair of end faces 44, 46, and an interior surface 50 and an exterior surface 52 extending between the end faces 44, 46. The positioning ring 14 is preferably made from spring steel to provide limited resiliency. The inner diameter 41 is smaller than the outer diameter 36 of the cylindrical portions 32, 34. The sidewall 42 includes a longitudinal split 43 and is sized to operatively position end faces 44, 46 adjacent retention surfaces 58, 60, respectively. The overlap between the inner diameter 41 of the ring 14 and the outer diameter of the nozzle body 12 provides means for rotationally and axially locking the ring 14 to the nozzle body 12 when the ring 14 is operatively positioned on the nozzle body 12.

The sidewall 42 further includes a pair of opposed spanner-receiving apertures 62, with one of the apertures 62 being disposed along the split 43.

A plurality of longitudinally extending teeth 54 depend inwardly from the interior surface 50 and are sized and configured to engage and interfere with polygon 39 of the nozzle body 12 in a nut-and-socket fashion. Preferred embodiments include twenty-four teeth 54, but other configurations are possible. It will be understood that the shape, size and number of teeth 54 should be selected to provide an adequate engagement with the polygon 39 so as to rotationally lock the positioning ring 14 to the nozzle body 12.

The external surface 52 includes conventional threads 64 that are configured to engage a threaded receiving aperture 60 (FIG. 8) in the drill bit 11 to retain the nozzle assembly 10 in the drill bit 11. A resilient O-ring 66 can be installed in the receiving aperture 60 to seal the distal end 18 in the receiving aperture 60.

In operation, the positioning ring 14 is coupled to the nozzle body 12 by being spread apart, pushed over the second cylindrical portion 34 and snapped into the recessed portion 38 to form the nozzle assembly 10. The nozzle assembly 10 is coupled to the drill bit 11 by threading the nozzle assembly 10 into the receiving aperture 60, using a twelve point wrench or socket, until it is fully seated. Once the assembly 10 is fully seated, the nozzle outlet direction 24 is compared to a known optimum direction and the difference is noted. The assembly 10 is uncoupled from the drill bit 11 and a conventional spanner wrench is inserted into the apertures 62 and used to ratchet the ring 14 about the recessed portion 38 until the difference is eliminated. When the ring 14 is properly positioned on the nozzle body 12, the nozzle assembly 10 is again coupled to the drill bit 11, with the nozzle outlet direction 24 aligned with the optimum direction.

Another embodiment of the nozzle assembly 110 is illustrated in FIGS. 9–13 and includes a nozzle body 112, a positioning ring 114, and a washer 168.

The nozzle body 112 includes a proximal end 115 (FIG. 9), a flange 116 extending radially outwardly from the proximal end 115, a distal end 118, an exterior surface 120 and an internal passage 122 defining a nozzle. The flange 116 includes a twelve point driven member 117, extending axially from the proximal end 115, and a retaining surface 119 facing the distal end 118. The nozzle 122 is substantially identical to nozzle 22 and includes an outlet 122*b* formed in the proximal end 115. The outlet 122*b* is oriented at an acute angle to the longitudinal axis 126 of the nozzle body 112.

The exterior surface 120 preferably includes first and second generally cylindrical portions 132, 134 having an outer diameter 136. A raised portion 138 is formed in the exterior surface 120 between the first and second cylindrical portions 132, 134 and includes a plurality of teeth 140 extending outwardly from the exterior surface 120.

Figure 11:
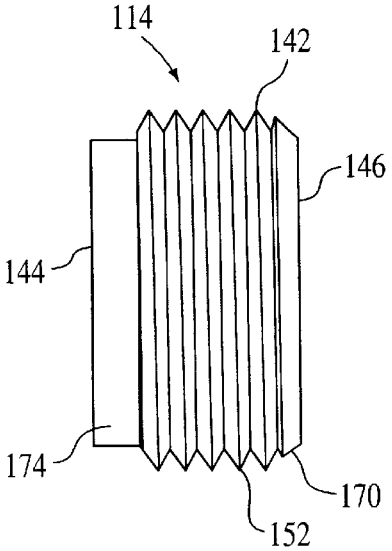
FIG. 11 is a side view of a positioning ring for use with the nozzle body of FIG. 9.
Figure 12:
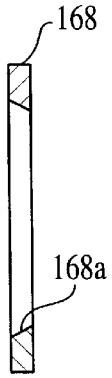
FIG. 12 is a section view of a retaining washer.
Figure 13:
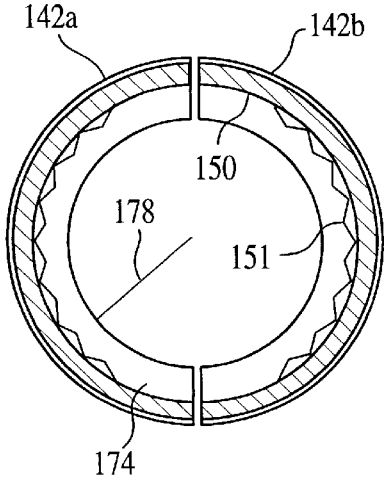
FIG. 13 is a transverse section view of another positioning ring for use with the nozzle body of FIG. 9.

The positioning ring 114, illustrated in FIGS. 11 and 13, includes a plurality of sidewall segments 142*a*, 142*b* that cooperate to form an annular sidewall 142. The sidewall 142 includes a pair of end faces 144, 146, an interior surface 150 and an exterior surface 152 extending between the end faces 144, 146, a beveled surface 170 adjacent the end face 146, and a cylindrical portion 174 adjacent the end face 146. The exterior surface 152 is threaded and substantially similar to the threaded exterior surface 52 illustrated in the embodiment of FIGS. 1–8.

The cylindrical portion 174 has an inner diameter 178 substantially equal to the outer diameter 136 and rests between the retaining surface 119 and the raised portion 138 when the ring 114 is installed on the nozzle body 112 thereby axially retaining the positioning ring 114 on the nozzle body 112. The interior surface 150 includes a plurality of longitudinally extending teeth 151 that extend radially inwardly from the sidewall 142 and are sized and configured to engage the teeth 140 on the nozzle body 112. The washer 168 includes a beveled aperture 168*a* configured to engage the beveled surface 170 to hold the sidewall segments 142*a*, 142*b* together until the nozzle assembly 110 is threaded into the drill bit 11.

In operation, the two positioning ring segments 142*a*, 142*b* of the positioning ring 114 are assembled around the raised portion 138 to engage the nozzle body teeth 140 with the positioning ring teeth 151 and position the cylindrical portion 174 between the retaining surface 119 and the raised portion 138. The washer 168 is installed on the beveled surface 170 and the nozzle assembly 110 is screwed into the drill bit 11 until it is fully seated. Once the assembly 110 is fully seated, the nozzle outlet direction is compared to a known optimum direction and the alignment difference is determined. The assembly 110 is removed from the drill bit 11, the washer 168 is removed, and the segments 142*a*, 142*b* are removed from the nozzle body 112 and reassembled at a corrected orientation around the raised portion 138 to compensate for the misalignment.

When the ring 114 is properly positioned on the nozzle body 112, the washer 168 is installed and the assembly 110 is threaded into the drill bit 11, with the outlet direction aligned with the optimum direction.

The above description and drawings are only illustrative of preferred embodiments of the present invention, and are not intended to limit the present invention. Any modification which comes within the spirit and scope of the following claims is to be considered part of the present invention.

What is new and desired to be protected by Letters Patent of the United States is:

1. A nozzle assembly comprising:

a nozzle body having a recessed portion; and a positioning ring coupled to the nozzle body, wherein the nozzle body and the positioning ring have selectively engageable surfaces for preventing rotation of the ring relative to the nozzle body, wherein the egageable surfaces include first engagement surfaces on the nozzle body and second engagement surfaces on the ring for engaging the first engagement surfaces, and wherein the first engagement surfaces include a plurality of facets that form a polygon in the recessed portion and the second engagement surfaces define teeth for engaging the facets.

2. The nozzle assembly of claim 1 wherein the nozzle body includes a recessed portion bounded by first and second retention surfaces, the positioning ring being operatively positioned to engage the nozzle body at the recessed portion and sized and configured to be operatively disposed between the first and second retention surfaces to axially retain the positioning ring on the nozzle body.

3. The nozzle assembly of claim 2 wherein teeth extend radially inwardly from an interior surface of the positioning ring to operatively engage the first and second retention surfaces to axially retain the positioning ring on the nozzle body.

4. The nozzle assembly of claim 1 further including a longitudinally extending gap in the positioning ring for installing the positioning ring on the nozzle body.

5. The nozzle assembly of claim 4 further including a second longitudinally extending gap for dividing the positioning ring into a plurality of segments.

6. A nozzle assembly comprising:

a nozzle body having a longitudinal axis, an internal passage oriented at an angle relative to the longitudinal axis, and an exterior surface with a first plurality of surfaces; and a ring coupled to the nozzle body and having an interior surface with a second plurality of surfaces engaging the first plurality of surfaces to prevent relative rotational movement between the ring and the nozzle body.

7. The nozzle assembly of claim 6 wherein the ring includes a threaded exterior surface configured to threadedly couple the nozzle assembly to a drill bit.

8. The nozzle assembly of claim 6 wherein the first plurality of surfaces form a recessed portion extending between first and second retention surfaces and the second plurality of surfaces extend radially inwardly from the interior surface of the ring to form teeth that operatively interfere with the first and second retention surfaces to axially retain the ring on the nozzle body.

9. A positioning ring for aligning a nozzle body relative to a drill bit, the positioning ring comprising:

rotational lock means for rotationally locking the ring to the nozzle body;

axial lock means for axially locking the ring to the nozzle body; and means for realigning the ring relative to the nozzle body, wherein the realigning means includes spanner-receiving apertures and a longitudinal split.

10. The ring of claim 9 wherein the rotational lock means includes a plurality of surfaces depending radially inwardly from an interior surface to form teeth to engage surfaces formed on the nozzle body, and wherein the axial lock means includes end surfaces of the teeth to engage retention surfaces on the nozzle body.

11. A nozzle assembly comprising:

a nozzle body having a longitudinal axis, an interior passage oriented at an angle relative to the longitudinal axis, an exterior surface having first and second generally transverse retention surfaces, and a plurality of surfaces extending between the first and second retention surfaces, the plurality of surfaces cooperating to form a polygon; and a resilient ring having a longitudinal axis, an interior surface having teeth configured to engage the plurality of surfaces to prevent the ring from rotating relative to the nozzle body, a threaded exterior surface, first and second end surfaces disposed to engage the first and second retention surfaces, respectively, to limit axial movement of the ring relative to the nozzle body, and a longitudinally extending split.

12. A nozzle assembly comprising:

a nozzle body having a longitudinal axis and an internal passage oriented at an angle to the longitudinal axis; and a resilient ring rotationally locked to the nozzle body and including means for correcting misalignment between the orientation of the internal passage and a predetermined orientation.

13. The nozzle assembly of claim 12 wherein the nozzle body includes an exterior surface having a first plurality of engagement surfaces, and the resilient ring includes an annular sidewall having a second plurality of engagement surfaces for engaging the first plurality of engagement surfaces to rotationally lock the ring to the nozzle body, and the correcting means includes a longitudinal split for expanding the diameter of the ring to permit rotation of the ring relative to the nozzle body.

14. A method of aligning a nozzle body in a receiver to direct an outlet of an internal passage of the nozzle body in a predetermined direction, the method comprising the steps of:

coupling a positioning ring to the nozzle body to form a nozzle assembly;

coupling the nozzle assembly to the receiver;

noting the amount of misalignment of the outlet from the predetermined direction;

uncoupling the nozzle assembly from the receiver;

correcting the misalignment of the outlet; and subsequently, coupling the nozzle assembly to the receiver.

15. The method of claim 14 wherein the correcting step includes the step of rotating the nozzle body relative to the positioning ring to compensate for the amount of misalignment.

16. The method of claim 14 wherein the positioning ring includes apertures and a longitudinal split passing through the positioning ring, and the rotating step includes the steps of inserting a tool into the apertures and ratcheting the ring relative to the nozzle body.

17. The method of claim 14 wherein the positioning ring includes means for ratcheting the positioning ring on the nozzle body to align the outlet with the predetermined direction.

18. The method of claim 17 wherein the ratcheting means includes a pair of spanner-receiving apertures and a longitudinal split extending through one of the apertures.

19. The method of claim 14 wherein the positioning ring includes a plurality of segments that cooperate to at least partially encircle the nozzle body.

* * * * *

UNITED STATES PATENT AND TRADEMARK OFFICE
Certificate

Patent No. 6,029,756 Patented: February 29, 2000

On petition requesting issuance of a certificate for correction of inventorship pursuant to 35 U.S.C. 256, it has been found that the above identified patent, through error and without deceptive intent, improperly sets forth the inventorship.

Accordingly, it is hereby certified that the correct inventorship of this patent is: Robert W. Britzke, Rogers, AR; Harry E. Nover, Woodlands, TX; and Robert W. Arfele, Houston, TX Signed and Sealed this Eighth Day of January 2002.

DAVID J. BAGNELL
*Supervisory Patent Examiner*
Art Unit 3672